US007357666B2

(12) United States Patent
Wu

(10) Patent No.: US 7,357,666 B2
(45) Date of Patent: Apr. 15, 2008

(54) CABLE WINDER

(76) Inventor: Sung Chiang Wu, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 11/489,949

(22) Filed: Jul. 20, 2006

(65) Prior Publication Data

US 2008/0064262 A1 Mar. 13, 2008

(51) Int. Cl.
*H01R 13/72* (2006.01)

(52) U.S. Cl. ..... 439/501

(58) Field of Classification Search ..... 439/610, 439/501, 638, 502, 164, 4, 3, 15, 21–22; 242/378, 378.1, 378.2, 385, 385.1, 385.4, 242/388, 388.1, 378.4
See application file for complete search history.

(56) References Cited

U.S. PATENT DOCUMENTS 6,416,355 B1 * 7/2002 Liao ..... 439/501
6,461,191 B1 * 10/2002 Chung ..... 439/501
6,733,328 B2 * 5/2004 Lin et al. ..... 439/501

* cited by examiner

*Primary Examiner*—Edwin A. Leon

(57) ABSTRACT

The present invention relates to cable winders, more particularly to a cable winder using the spring force of a spiral spring to pull back a signal transmission cable automatically. The cable winder further includes a clamping part and a spiral rail for retaining the cable by sections, whereby the cable winder will retain the length of the cable better. Further, the cable winder has only one cable (whose two terminals respectively connected to two connectors), thereby removing the problem of deteriorating electric contact in a conventional two-cable winder after long-term frictional erosion that result in signal distortions and noises.

11 Claims, 10 Drawing Sheets

CABLE WINDER

FIELD OF THE INVENTION

The present invention relates to cable winders, more particularly to a cable winder using the spring force of a spiral spring to pull back a signal transmission cable automatically. The cable winder further includes a clamping part and a spiral rail for retaining the cable by sections, whereby the cable winder will retain the length of the cable better. Further, the cable winder has only one cable (whose two terminals respectively connected to two connectors), thereby removing the problem of deteriorating electric contact in a conventional two-cable winder after long-term frictional erosion that result in signal distortions and noises.

BACKGROUND OF THE INVENTION

A cable winder connecting a USB (Universal Series Bus) connector and an earphone module of the prior art usually uses two independent signal transmission cables respectively for the USB (Universal Series Bus) connector and the earphone module. The signal transmission goes through a fixed circuit board for the USB (Universal Series Bus) connector and a rotary circuit board for the earphone module; the circuit boards are electrically connected and may be rotated against each other. The configuration is disadvantage in that the electric connection may wear out by long-term frictional contact, which may result in signal distortions and noises.

Referring to FIGS. 1 and 2, a cable winder of the prior art comprises a clamping part 12 (for example, a retaining tongue or a roller) located in a rail mount 13 for restricting the rotation of the mount, a pair of signal transmission cables, and a spiral spring 14 for restoring the pullout of the cables. The transmission cables further comprises a first cable A111 for an earphone module 11 and a second cable B151 for a USB (Universal Series Bus) connector 15. The first cable A111 has one terminal connected to an earphone circuit board 112, and the second cable B151 is connected to a circuit board 16. The circuit boards 112 and 15 are electrically connected by a ring conductive contact on one side of the circuit board 112 and an electric contact point 161 on the circuit board 16; the circuit boards 112 and 15 may rotate against each other so that electrical conduction always exist even the first cable A111 is being pulled. Due to continuous friction between the ring conductive contact and the electric contact point 161, the electric connection may wear out by long-term frictional contact, which may result in signal distortions and noises.

Base on the above disadvantage of electric contact erosion and the spirit of easy portability, the present invention is an improvement from the conventional cable winders.

SUMMARY OF THE INVENTION

The primary objective of the present invention is to provide a cable winder wherein a signal transmission cable is wound around a rotary mount that has a spiral spring for automatically pulling back the transmission cable, whereby the operation of the cable will be smooth.

The secondary objective of the present invention is to provide a cable winder wherein a clamping part and a spiral rail are provided so that the cable will slide along the rail and stop after being pulled out a fixed distance when the clamping part is engaged with a retaining slot. Therefore, the transmission cable can be retained section by section.

The third objective of the present invention is to provided a cable winder wherein two connectors respective for the USB (Universal Series Bus) connector and the output device (such as an earphone) are linked directly, thereby preventing signal distortions and noises due to electric contact erosion.

To achieve above object, the present invention provides a cable winder, which comprises an upper shell provided with retaining slots and retaining columns on an inner wall thereon; a lower shell covering a lower half of said cable winder, said lower shell having a cable outlet and a central shaft extending upright on an inner wall thereon; a clamping part retained by said retaining slots of said upper shell; a rail mount provided with a spiral rail with a retaining slot therein, one end of said clamping part being slidably embedded in said spiral rail, said retaining slot of said spiral rail stopping said clamping part when said clamping part slides into said retaining slot; a rotary tray having a central through hole of passing said shaft of said lower shell, an upper receptacle and a lower receptacle; a spiral spring mounted within said upper receptacle of said rotary tray, a middle point of said spiral spring being fixed by a notch on said shaft of said lower shell, whereby said spiral spring will provide a restoring force against the movement of said rotary tray; and a signal transmission cable, a first section of said cable being wound several times around said shaft within an inner part of said lower receptacle of said rotary tray and being fixed by a retaining column, whereby a first terminal will be extended outside said lower shell along said shaft, a second section of said cable being wound several times in an opposite direction to said first section around said shaft within an outer part of said lower receptacle of said lower shell, a second terminal of said second section being extended out of said lower shell through said cable outlet, said first and second terminals being capable of being installed with a connector; whereby said rotary tray, together with said spiral spring and said signal transmission cable, will be retained between said upper and said lower shells, and whereby said first section of said cable in said inner part of said lower receptacle will be loosened when said second section of said cable in said outer part is pull out of said lower receptacle and said first section of said cable in said inner part of said lower receptacle will be tightened when said second section of said cable in said outer part is retracted into said lower receptacle, and whereby a section of said cable pulled out of said lower shell will maintain a fixed length due to said clamping part being retained within said retaining slot in said spiral rail on said rail mount after said clamping part slides over a fixed distance.

The various objects and advantages of the present invention will be more readily understood from the following detailed description when read in conjunction with the appended drawings.

DETAILED DESCRIPTION OF THE PREFERRED EMBODIMENTS

Figure 1:
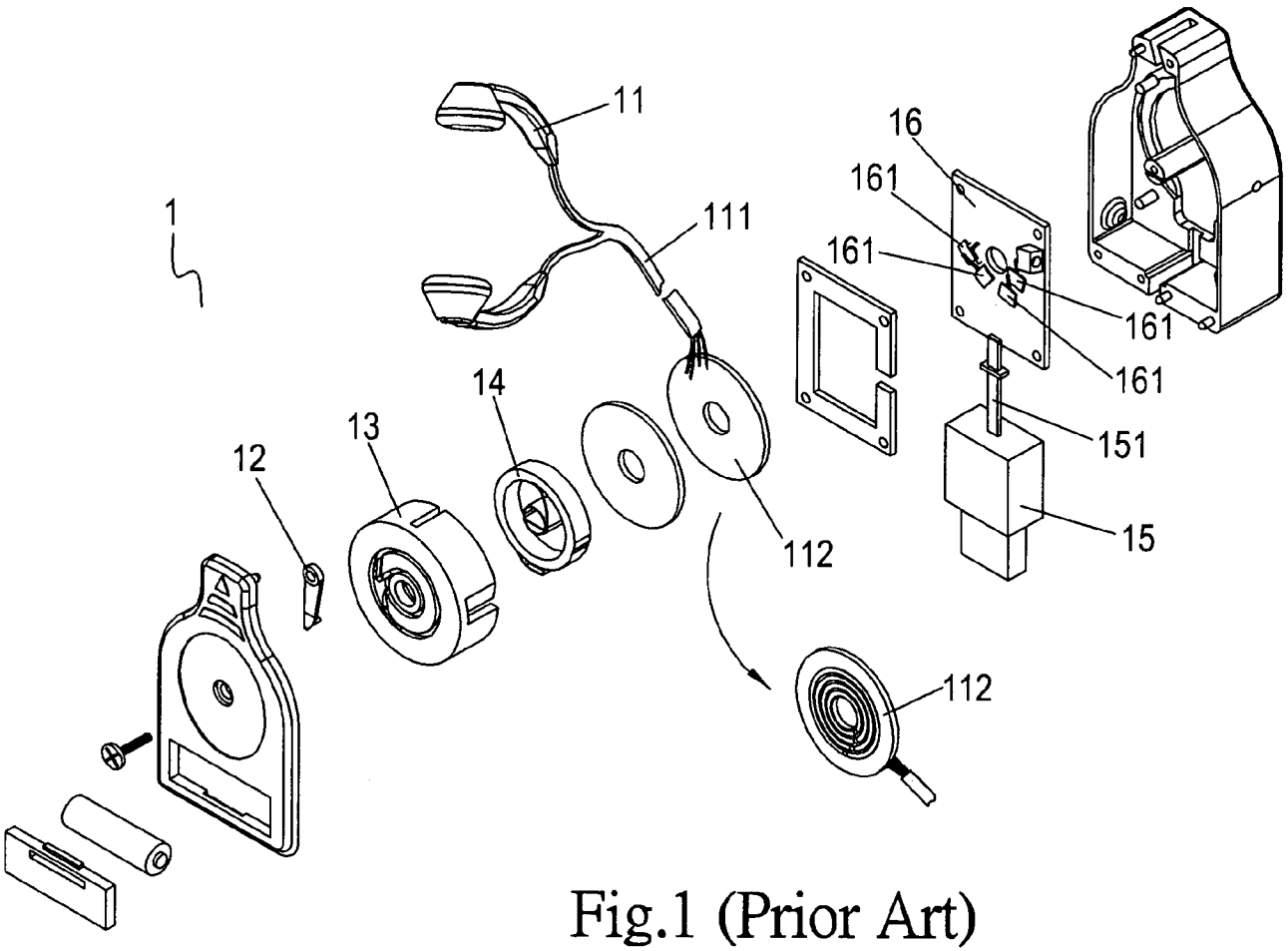
Fig.1 (Prior Art)
FIG. 1 is an exploded perspective view of a cable winder of the prior art.
Figure 2:
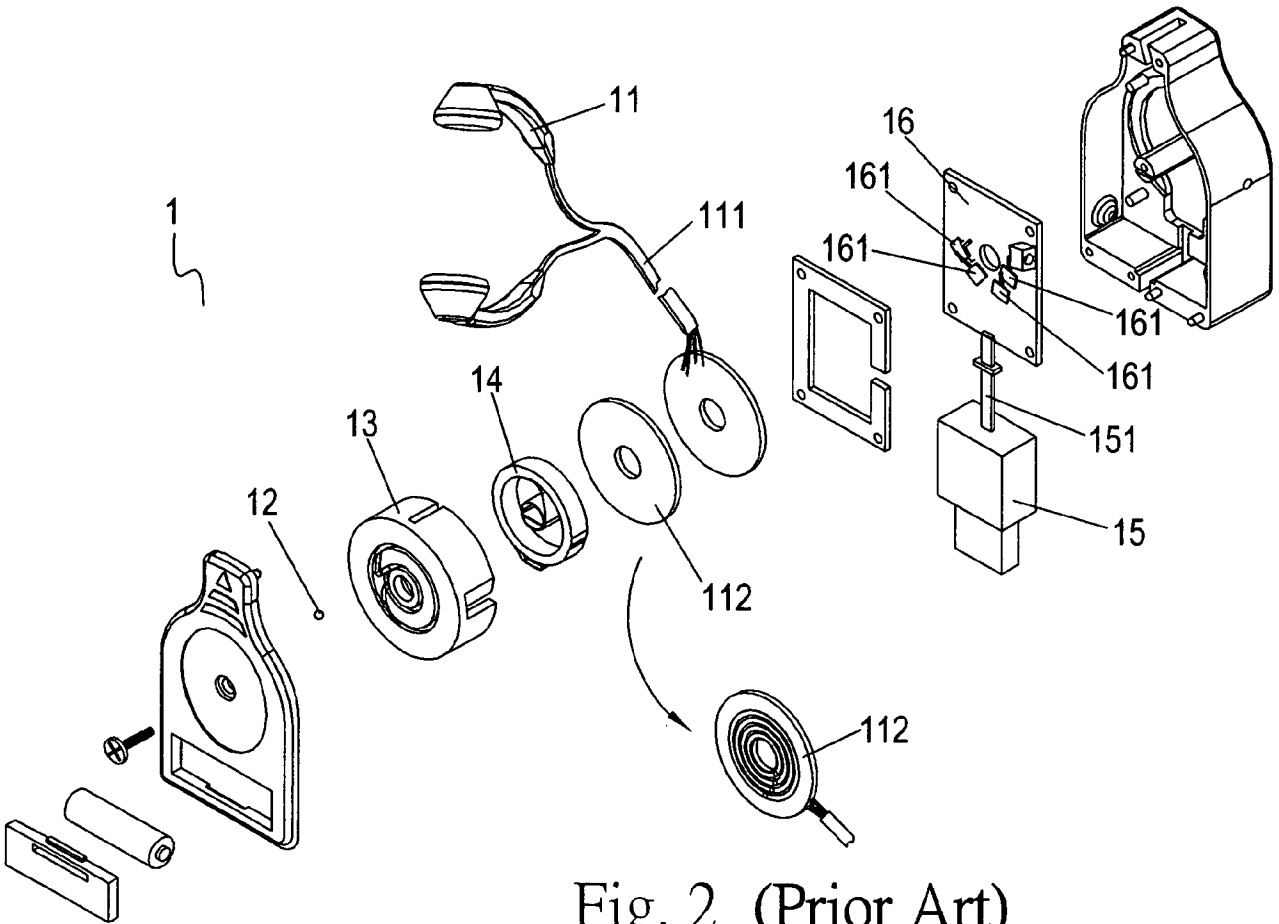
Fig. 2 (Prior Art)
FIG. 2 is an exploded perspective view of another preferred embodiment of a cable winder of the prior art.
Figure 3:
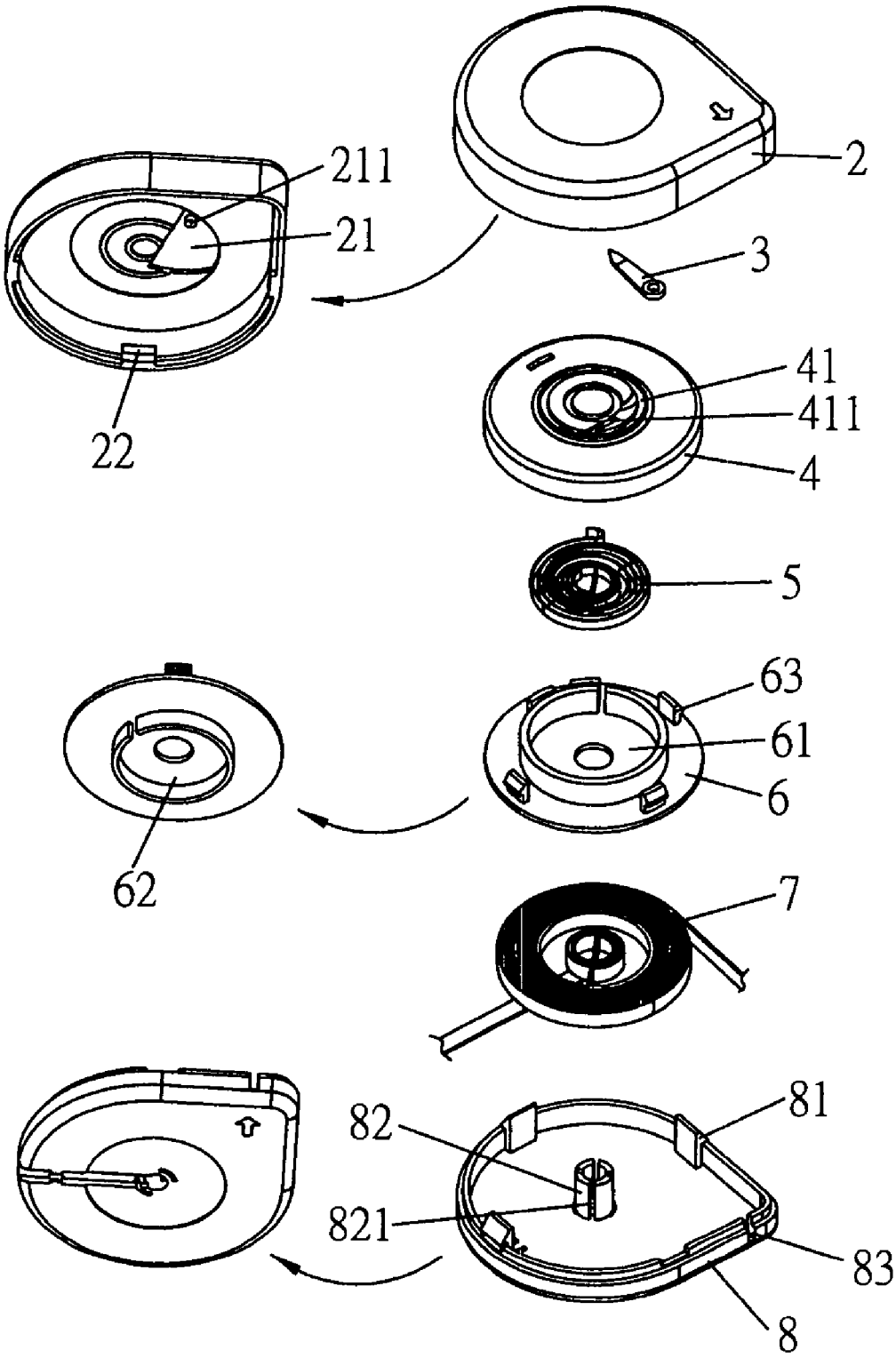
FIG. 3 is an exploded perspective view of a cable winder of the present invention.
Figure 4:
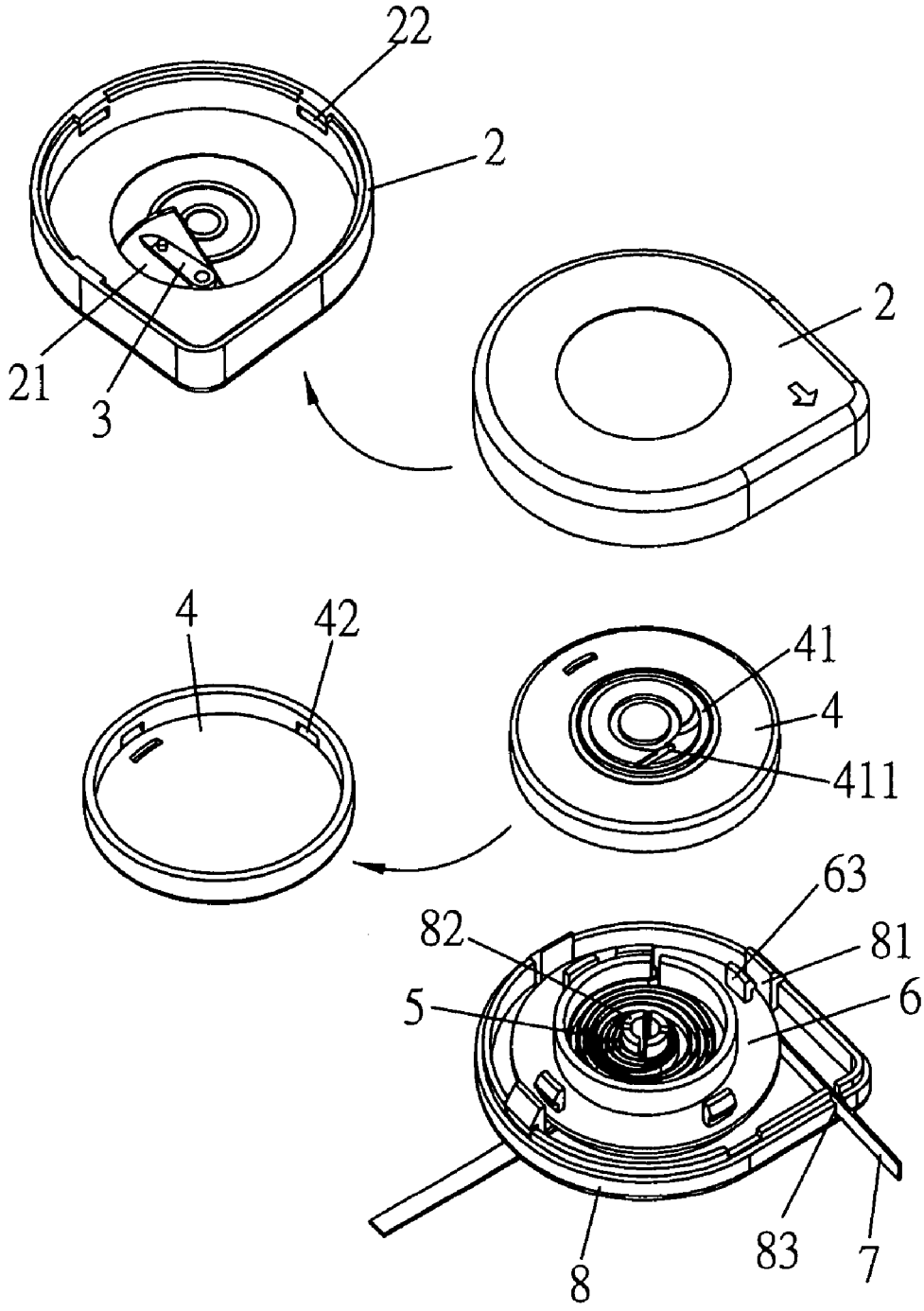
FIG. 4 illustrates the assembly of the cable winder in FIG. 3.
Figure 5:
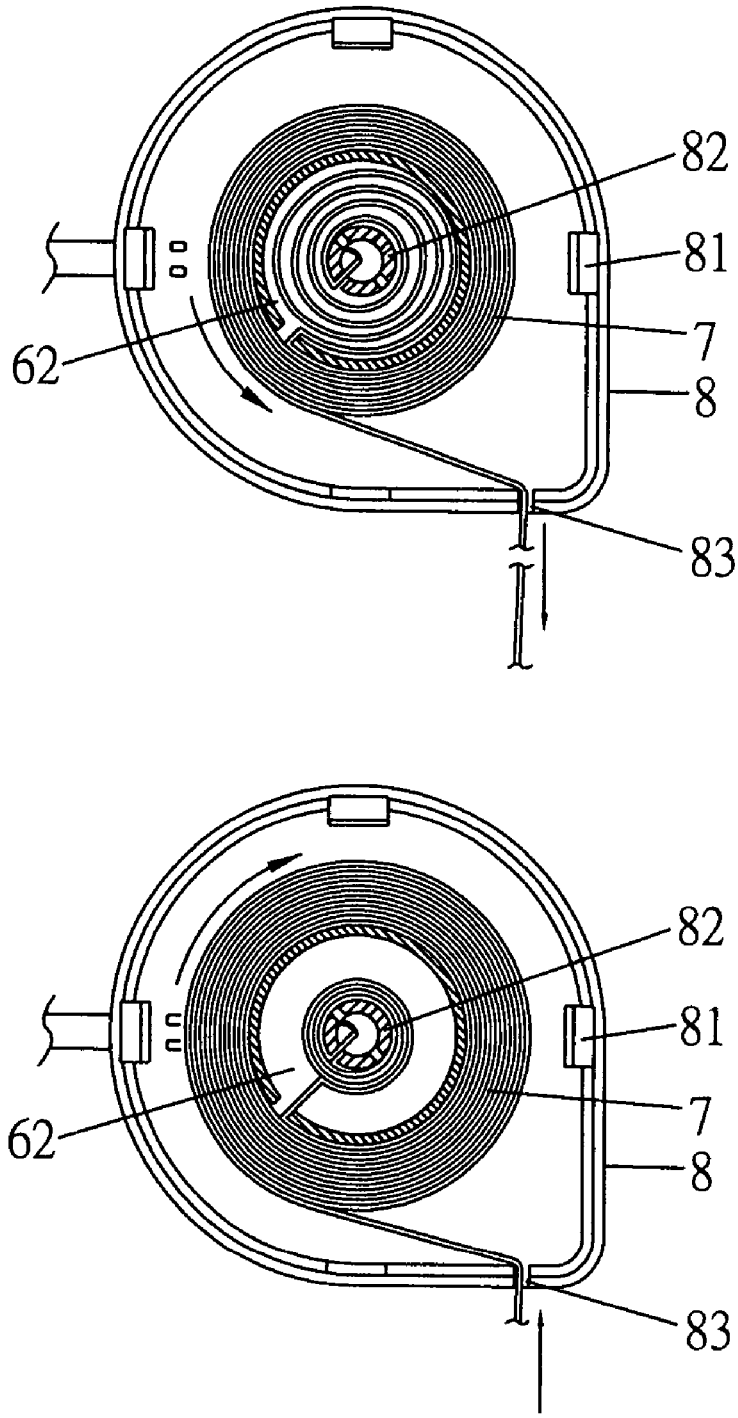
FIG. 5 illustrates the winding of the signal transmission cable in the cable winder in FIG. 3.

Referring to FIGS. 3, 4 and 5, a cable winder according to the present invention comprises an upper shell 2, clamping part 3, a rail mount 4, a spiral spring 5, a rotary tray 6, a signal transmission cable 7 and a lower shell 8. The rail mount 4 and the rotary tray 6 are retained between the upper shell 2 and the lower shell 8. A central shaft 82 on the inner wall of the lower shell 8 extends upright to confine the spiral spring 5 and the rotary tray 6. The inner wall of the upper shell 2 is provided with retaining slots 21 for confining the movement of the clamping part 3, retaining columns 211 for retaining the clamping part 3 and releases A22. The rail mount 4 is provided with a spiral rail 41 with a retaining slot 411 therein. One end of the clamping part 3 is slidably embedded in the spiral rail 41. The retaining slot 411 of the spiral rail 41 stops the clamping part 3 when it slides into the retaining slot 411. The rotary tray 6 is located under rail mount 4 and has an upper receptacle 61 for housing the spiral spring 5 and a lower receptacle 62 for housing the signal transmission cable 7. The signal transmission cable 7 has a first section wound several times around the shaft 82 within an inner part of the lower receptacle 62 of the lower shell 8 and extended outside the lower shell 8 along the shaft 82 and a second section wound several times in an opposite sense to the first section around the shaft 82 within an outer part of the lower receptacle 62 of the rotary tray 6 and extended out of the lower shell 8 through a cable outlet 83. The first and second terminals are capable of being installed with a connector. The spiral spring 5 is mounted within the upper receptacle 61 of the rotary tray 6. A middle point of the spiral spring 5 is fixed by a notch 821 on the shaft 8 of the lower shell 8, whereby the spiral spring 5 will provide a restoring force against the movement of the rotary tray 6.

Thereby, the rotary tray 6, together with the spiral spring 5 and the signal transmission cable 7, will be retained between the upper shell 2 and the lower shell 8. The first section of the cable 7 in the inner part of the lower receptacle 62 will be loosened when the second section of the cable 7 in said outer part is pull out of the lower shell 8 and the first section of the cable 7 in the inner part of the lower receptacle 62 will be tightened when the second section of the cable 7 in the outer part is retracted into the lower shell 8. A section of the cable 7 pulled out of the lower shell 8 will maintain a fixed length due to the clamping part 3 being retained within the retaining slot 411 in the spiral rail 41 on the rail mount 4 after the clamping part 3 slides over a fixed distance.

Figure 6:
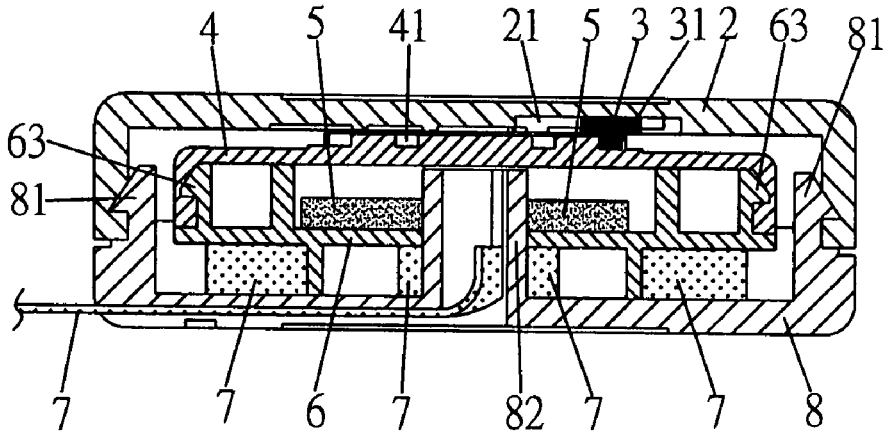
FIG. 6 is a lateral cross-sectional view of the cable winder in FIG. 3.
Figure 7:
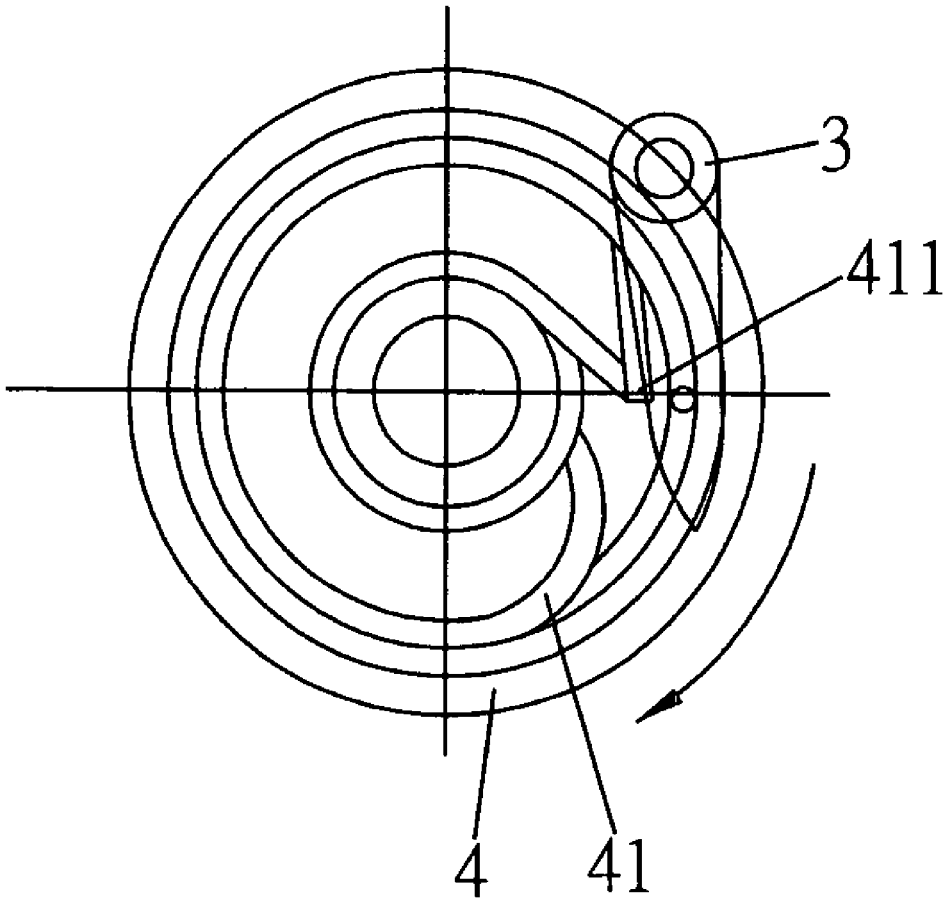
FIG. 7 illustrates the sliding of the clamping part.

Referring to FIGS. 6 and 7, as the signal transmission cable 7 is pulled out of the lower shell 8, it will maintain a fixed length due to the clamping part 3 being retained within the retaining slot 411 in the spiral rail 41 on the rail mount 4, after the clamping part 3 is driven by the pulled cable 7 to slide along the spiral rail 41 over a fixed distance. Since the length of the section of the cable 7 pulled out can be maintained, the cable winder can be connected an external electronic device easily.

Figure 8:
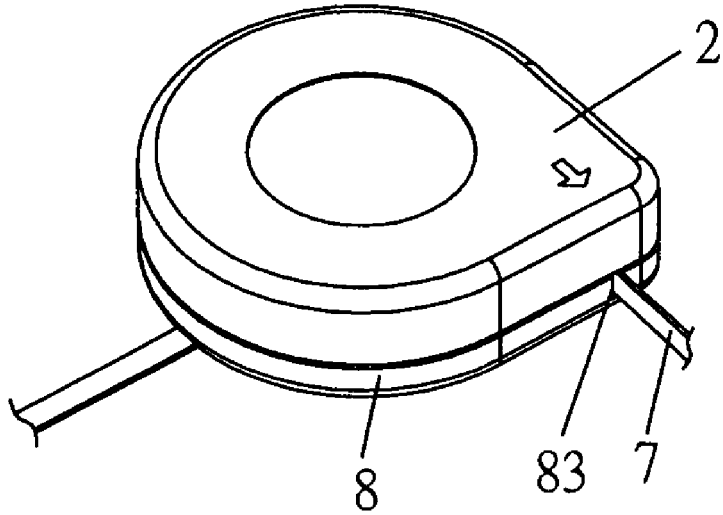
FIG. 8 is a perspective view of the cable winder in FIG. 3.
Figure 8:
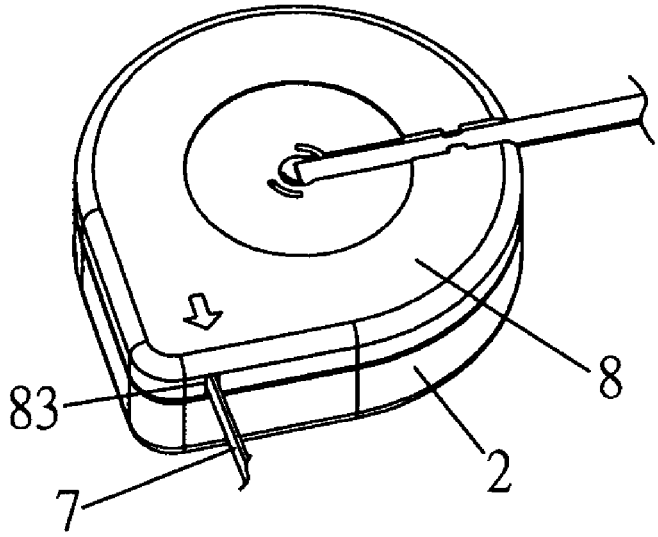
Figure 9:
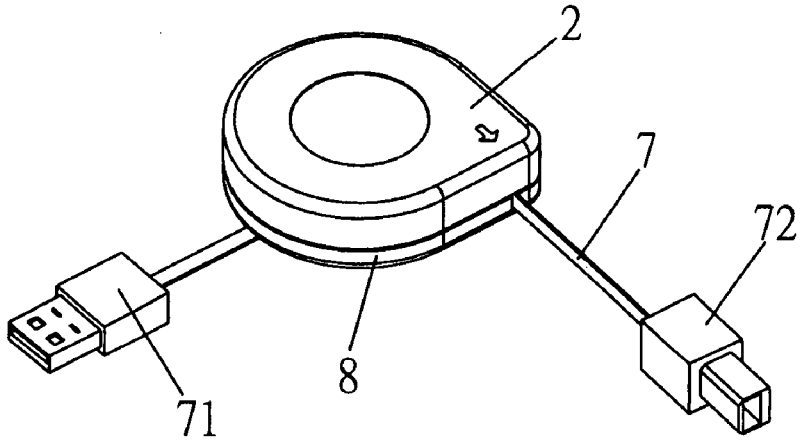
FIG. 9 is another perspective view of a preferred embodiment of the present invention.

Referring to FIGS. 8 and 9, two terminals of the signal transmission cable 7 are provided with connectors 71, 72 (wherein the two terminals of the signal transmission cable 7 are hidden in the respective one of the two connectors 71, 72 and thus not shown) selected from a USB (Universal Series Bus) connector, a mini USB (Universal Series Bus) connector, an IEEE 1394 connector, a RJ11 connector and a RJ45 connector. A terminal of the signal transmission cable 7 can be connected to a connector of an audio source, an earphone with a wire connector or a connector of a charging device within an automobile.

Figure 10:
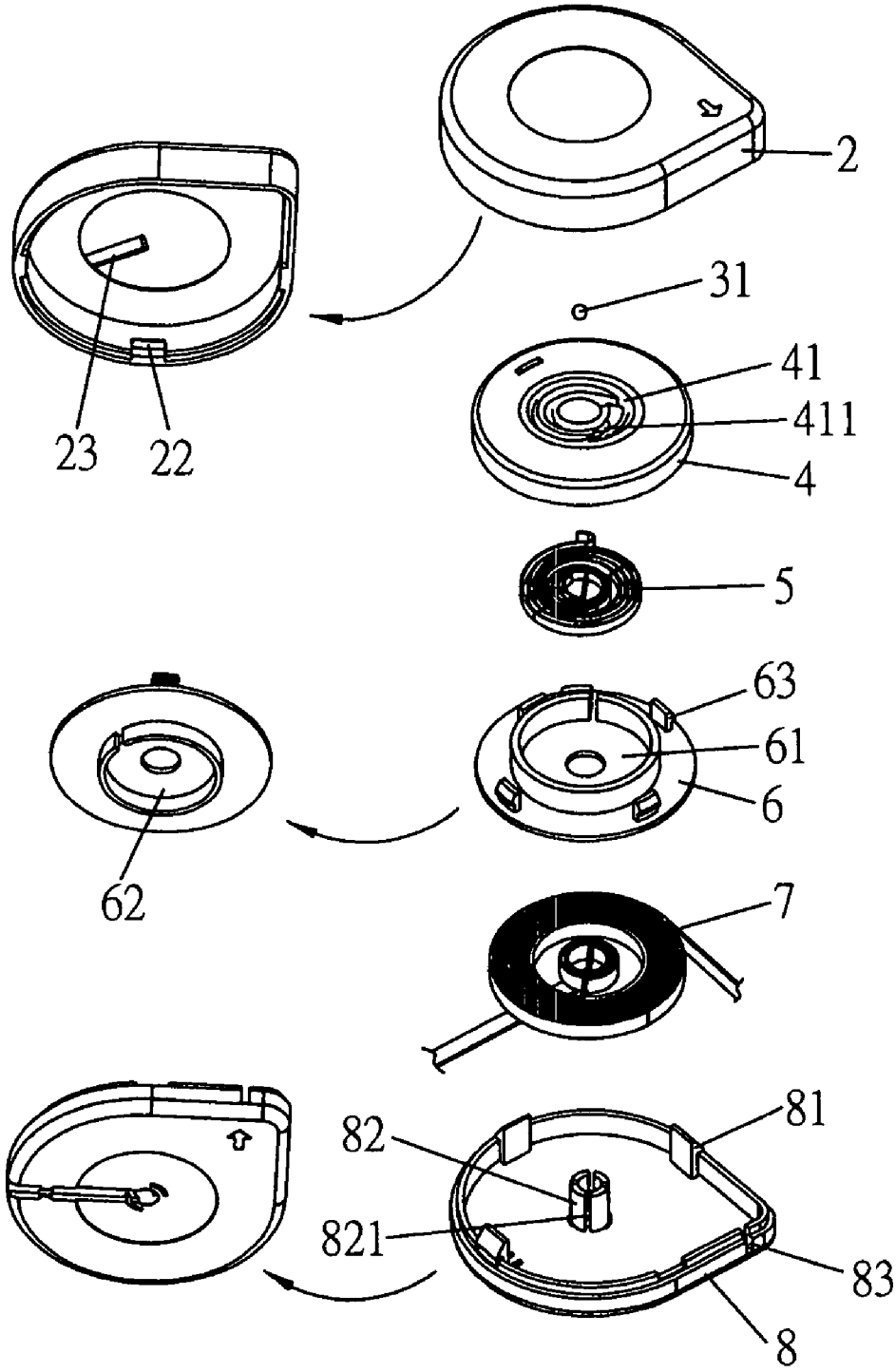
FIG. 10 is a perspective view of another preferred embodiment of the present invention wherein the clamping part is a rolling ball.

Referring to FIG. 10, the clamping part 3 of the present invention is a rolling ball 31, and the retaining slot 21 on the upper shell 2 is a rolling ball slot 23. Further, the spiral rail 41 on the rail mount 4 is designed for the rolling of the rolling ball 31. The rest of the components are the same as the above preferred embodiments.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A cable winder, comprising:

an upper shell provided with retaining slots and retaining columns on an inner wall of the upper shell;

a lower shell covering a lower half of said cable winder, said lower shell having a cable outlet and a central shaft extending upright on an inner wall of the lower shell;

a clamping part retained by said retaining slots of said upper shell;

a rail mount provided with a spiral rail having a retaining slot, one end of said clamping part being slidably embedded in said spiral rail, said retaining slot of said spiral rail stopping said clamping part when said clamping part slides into said retaining slot;

a rotary tray having a central through hole of passing said shaft of said lower shell, an upper receptacle and a lower receptacle;

a spiral spring mounted within said upper receptacle of said rotary tray, a middle point of said spiral spring being fixed by a notch on said shaft of said lower shell, whereby said spiral spring will provide a restoring force against the movement of said rotary tray; and a signal transmission cable, a first section of said cable being wound several times around said shaft within an inner part of said lower receptacle of said rotary tray and being fixed by the retaining column, whereby a first terminal will be extended outside said lower shell along said shaft, a second section of said cable being wound several times in an opposite direction to said first section around said shaft within an outer part of said lower receptacle of said lower shell, a second terminal of said second section being extended out of said lower shell through said cable outlet, said first and second terminals being capable of being installed with a connector;

whereby said rotary tray, together with said spiral spring and said signal transmission cable, will be retained between said upper and said lower shells, and whereby said first section of said cable in said inner part of said lower receptacle will be loosened when said second section of said cable in said outer part is pull out of said lower receptacle and said first section of said cable in said inner part of said lower receptacle will be tightened when said second section of said cable in said outer part is retracted into said lower receptacle, and whereby a section of said cable pulled out of said lower shell will maintain a fixed length due to said clamping part being retained within said retaining slot in said spiral rail on said rail mount after said clamping part slides over a fixed distance.

2. The cable winder of claim 1 wherein said clamping part is a retaining tongue.

3. The cable winder of claim 1 wherein two terminals of said signal transmission cable are provided with connectors selected from a USB (Universal Series Bus) connector, a mini USB (Universal Series Bus) connector, an IEEE 1394 connector, a RJ11 connector and a RJ45 connector.

4. The cable winder of claim 1 wherein a terminal of said signal transmission cable can be connected to a connector of an audio source.

5. The cable winder of claim 1 wherein a terminal of said signal transmission cable can be connected to an earphone with a wire connector.

6. The cable winder of claim 1 wherein a terminal of said signal transmission cable can be connected to a connector of a charging device within an automobile.

7. A cable winder, comprising:

an upper shell provided with retaining slots and retaining columns on an inner wall of the upper shell;

a lower shell covering a lower half of said cable winder, said lower shell having a cable outlet and a central shaft extending upright on an inner wall of the lower shell;

a rolling ball embedded within one of said retaining slot;

a rail mount provided with a spiral rail having a retaining slot, one end of said rolling ball being slidably embedded in said spiral rail, said retaining slot of said spiral rail stopping said rolling ball when said rolling ball slides into said retaining slot;

a rotary tray having a central through hole of passing said shaft of said lower shell, an upper receptacle and a lower receptacle;

a spiral spring mounted within said upper receptacle of said rotary tray, a middle point of said spiral spring being fixed by a notch on said shaft of said lower shell, whereby said spiral spring will provide a restoring force against the movement of said rotary tray; and a signal transmission cable, a first section of said cable being wound several times around said shaft within an inner part of said lower receptacle of said rotary tray and being fixed by the retaining column, whereby a first terminal will be extended outside said lower shell along said shaft, a second section of said cable being wound several times in an opposite direction to said first section around said shaft within an outer part of said lower receptacle of said lower shell, a second terminal of said second section being extended out of said lower shell through said cable outlet, said first and second terminals being capable of being installed with a connector;

whereby said rotary tray, together with said spiral spring and said signal transmission cable, will be retained between said upper and said lower shells, and whereby said first section of said cable in said inner part of said lower receptacle will be loosened when said second section of said cable in said outer part is pull out of said lower receptacle and said first section of said cable in said inner part of said lower receptacle will be tightened when said second section of said cable in said outer part is retracted into said lower receptacle, and whereby a section of said cable pulled out of said lower shell will maintain a fixed length due to said rolling ball being retained within said retaining slot in said spiral rail on said rail mount after said rolling ball slides over a fixed distance.

8. The cable winder of claim 7 wherein two terminals of said signal transmission cable are provided with connectors selected from a Universal Series Bus connector a mini Universal Series Bus connector, an IEEE 1394 connector, a RJ11 connector and a RJ45 connector.

9. The cable winder of claim 7 wherein a terminal of said signal transmission cable can be connected to a connector of an audio source.

10. The cable winder of claim 7 wherein a terminal of said signal transmission cable can be connected to an earphone with a wire connector.

11. The cable winder of claim 7 wherein a terminal of said signal transmission cable can be connected to a connector of a charging device within an automobile.

* * * * *